US007018253B2

(12) United States Patent
Li

(10) Patent No.: US 7,018,253 B2
(45) Date of Patent: Mar. 28, 2006

(54) COUPLING LOCK FOR AN ENGINE AND A BOAT HULL

(75) Inventor: Show-Mon Li, Changhua (TW)

(73) Assignee: Vulcan Sports Co., Ltd., Changhua (TW)

( * ) Notice: Subject to any disclaimer, the term of this patent is extended or adjusted under 35 U.S.C. 154(b) by 0 days.

(21) Appl. No.: 10/912,336

(22) Filed: Aug. 6, 2004

(65) Prior Publication Data

US 2006/0030225 A1 Feb. 9, 2006

(51) Int. Cl.
*B63H 20/08* (2006.01)

(52) U.S. Cl. ..... 440/55; 70/164

(58) Field of Classification Search ..... 440/53, 440/55, 58; 70/164, 229, 230, 231, 232; 114/363

See application file for complete search history.

(56) References Cited

U.S. PATENT DOCUMENTS

| | | | | | |
|---|---|---|---|---|---|
| 2,500,375 | A * | 3/1950 | Parker | 70/232 |
| 3,505,839 | A * | 4/1970 | Pavek | 70/230 |
| 4,030,324 | A * | 6/1977 | Rizio | 70/232 |
| 4,058,994 | A * | 11/1977 | Coppola | 70/232 |
| 4,228,983 | A * | 10/1980 | Bowman, Jr. | 70/232 |
| 4,658,607 | A * | 4/1987 | Muse et al. | 70/164 |
| 4,729,336 | A * | 3/1988 | Rohne | 114/363 |
| 5,309,742 | A * | 5/1994 | Lawrence | 70/232 |
| 6,676,465 | B1 * | 1/2004 | Karvinen | 440/55 |

* cited by examiner

*Primary Examiner*—Lars A. Olson
(74) *Attorney, Agent, or Firm*—Troxell Law Office, PLLC

(57) ABSTRACT

A coupling lock for an engine and a boat hull installed on the fastening location thereof to provide coupling and locking functions includes a base dock and a upper dock. The base dock is fastened to a transom of the boat to couple with the engine and fasten to the boat. The base dock has two corresponding fastening rods to insert in fastening holes formed on a lock body housed in the upper dock. Locking operation may be accomplished rapidly. The engine coupling section is covered to guard the engine from theft.

3 Claims, 8 Drawing Sheets

COUPLING LOCK FOR AN ENGINE AND A BOAT HULL

BACKGROUND OF THE INVENTION

1. Field of the Invention

The invention relates to a coupling lock for an engine and a boat hull and particularly to a coupling lock installed on a fastening location of an engine and a boat hull to provide fast locking and theft-proof functions.

2. Description of the Prior Art

Sea-bound recreational activities are loved by many people. Ownership of private motorboat grows constantly. As the motorboat is quite expensive, theft often occurs, especially the engine. A generally engine 10 is installed on a transom W at the stern (as shown in FIG. 1) and is fastened by a blot 11. However, the bolt 11 may be easily removed from the transom W by turning a handle 12 at the distal end of the bolt 11, and the engine 10 may be separated from the transom W and taken away. To prevent the engine from being stolen, some boat owners remove the engine and carry it home every time they finish using the boat. For a larger engine, removing and carrying the engine is difficult and troublesome. Therefore a locking device that is simple to install to guard the engine from being stolen is urgently needed. U.S. Pat. No. 6,675,465B2 discloses such an example (called the cited reference hereinafter). However, the cited reference still has drawbacks, notably a upper seat and a lower seat have to be coupled first, then a lock body is inserted in a preset bore formed on the upper seat to do locking operation. Locking operation is tedious. Once the lock is removed, it is easy to get lost. All this causes a lot of problems in use. This is still room for improvement.

SUMMARY OF THE INVENTION

Therefore the primary object of the present invention is to solve the aforesaid disadvantages occurred to the conventional techniques that unable to lock the engine on the boat and tend to lose the lock even if a lock is provided. The invention provides a lock function that can be executed quickly.

The coupling lock for an engine and a boat hull according to the present invention mainly includes a base dock and a upper dock. The base dock is fastened to a transom of the boat to engage with an engine coupling section for fastening to the hull. The base dock has two corresponding fastening rods to insert in fastening holes of a lock body held in the upper dock when the upper dock is coupled with the base dock to allow locking to be done rapidly and cover the engine coupling section to guard the engine against theft.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
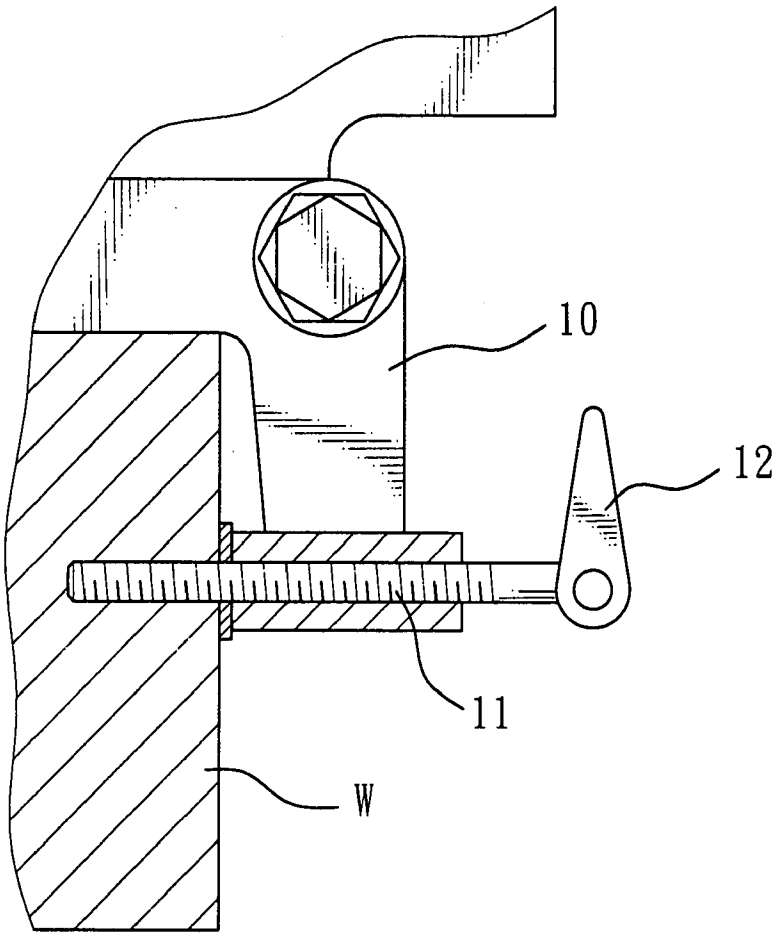
FIG. 1 PRIOR ART
FIG. 1 is a fragmentary sectional view of a conventional boat hull and an engine.
Figure 2:
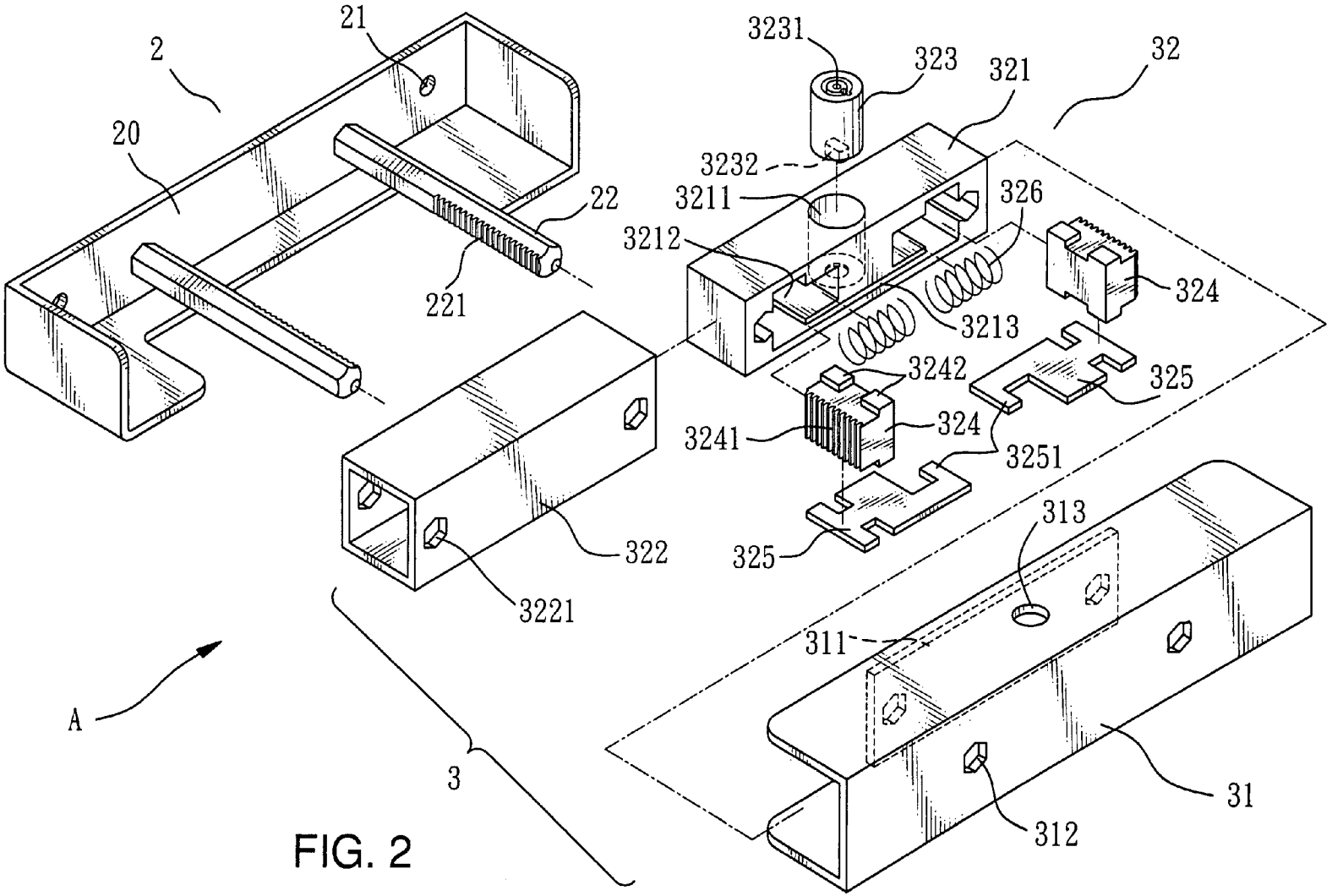
FIG. 2 is an exploded view of the present invention.
Figure 3:
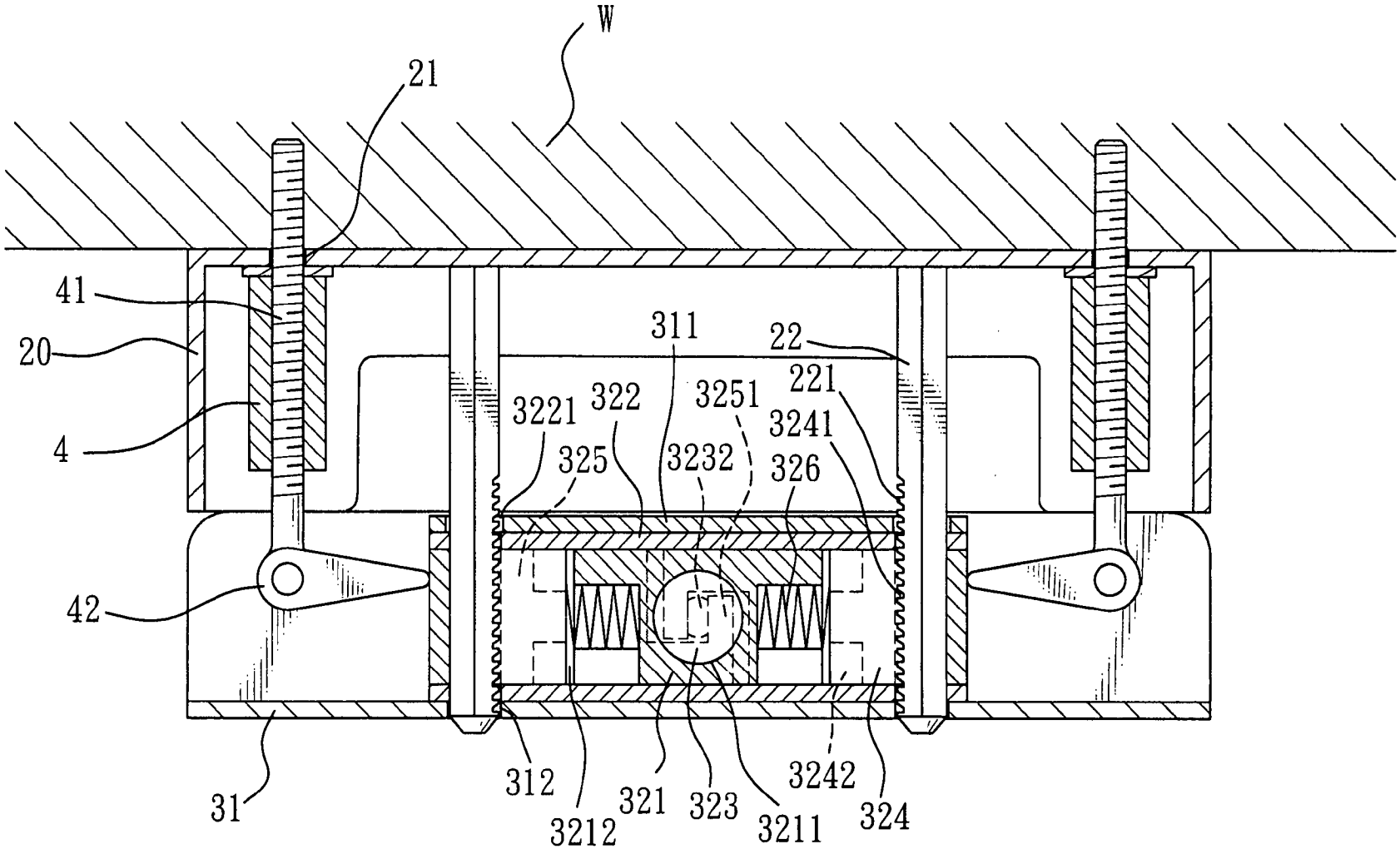
FIG. 3 is a sectional view of the present invention in a locking condition.

Referring to FIGS. 2 and 3, the coupling lock A for an engine and a boat hull according to the invention mainly includes a base dock 2 and a upper dock 3.

The base dock 2 has a seat 20 which has respectively a side plate on two sides, two bore 21 on the bottom and two fastening rods 22 extended outwards. The inner side of each fastening rod 22 has a first gear rack 221.

The upper dock 3 includes a frame 31 and a lock body 32.

The frame 31 is a ⊓-shape plate having an opening which is coupled with a retaining plate 311 in the center to form a housing compartment to hold the lock body 32. The retaining plate 311 and the frame 31 have two corresponding holes 312 to allow the fastening rods 22 to run through. One side of the frame 31 has a round opening 313 in the center.

The lock body 32 is held in the upper dock 3 and includes a lock plug 321, a lock case 322, a lock core 323, two latch members 324, two sliding plates 325 and two springs 326.

The lock plug 321 has a housing chamber 3211 in the center to hold the lock core 323, two latch troughs 3212 on two ends of the front side corresponding to each other, a sliding trough 3213 on a lower side communicating with the two latch troughs 3212 and the housing chamber 3211 located thereabove.

The lock case 322 is a hollow member located between the frame 31 and the retaining plate 311 to hold the lock plug 321. It has apertures 3221 on two sides to allow the fastening rods 22 to run through.

The lock core 323 is housed in the housing chamber 3211 of the lock plug 321 and has a keyway 3231 on one end and a lock bolt 3232 on another end which is turnable about a fixed point when the keyway 3231 rotates to perform locking and unlocking operation.

The two latch members 324 are located in the latch troughs 3212, and have respectively a second gear rack 3241 on one side mating the fastening rod 22 and two stubs 3242 extended respectively from the upper side and the lower side.

The two sliding plates 325 are located in the sliding trough 3213 in an inverse manner. They have one end coupled with the lower side of the latch member 324 and another end forming a hook 3251 to latch one side of the lock bolt 3232. The turning of the lock bolt 3232 can control the movement of the latch members 324 to engage or disengage the second gear rack 3241 with the first gear rack 221 of the fastening rods 22.

The two springs 326 are housed in the latch troughs 3212 and have one end pressing one side of the latch members 324.

Figure 4:
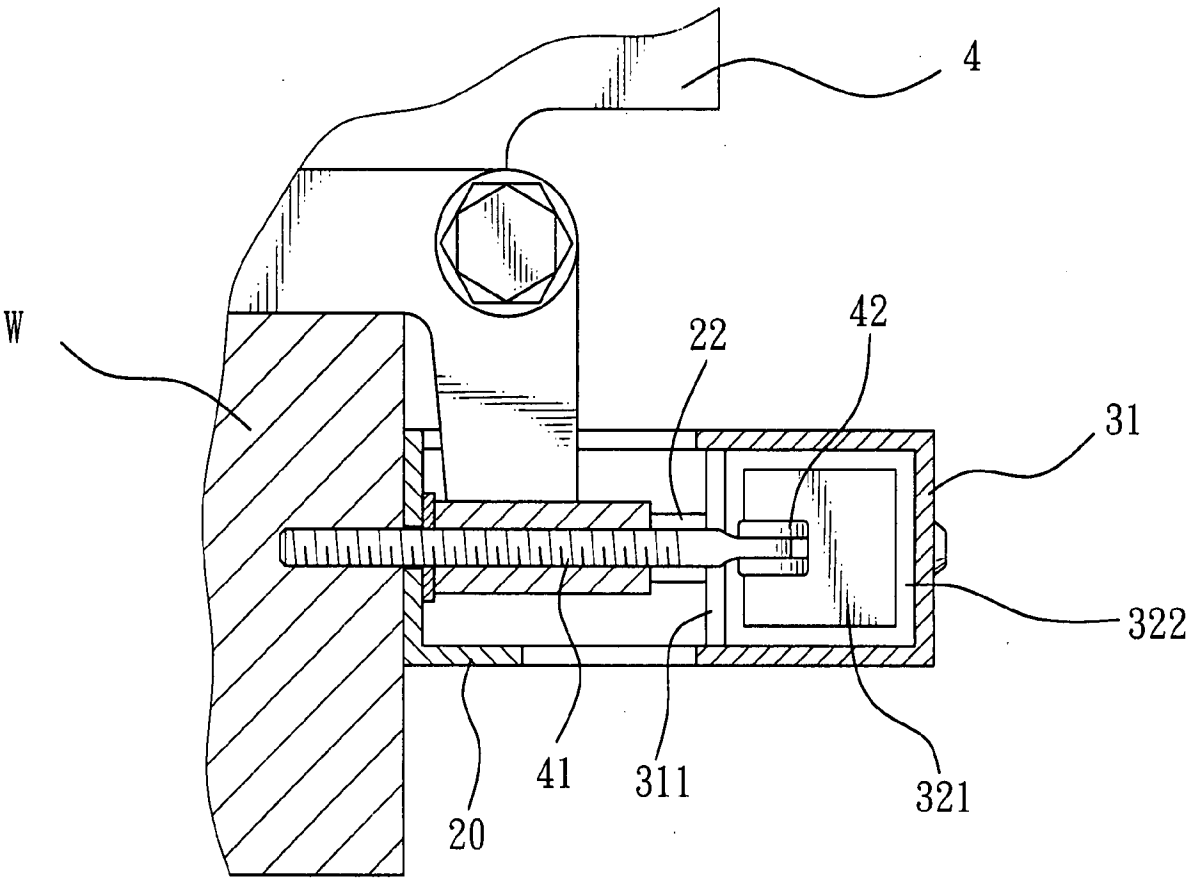
FIG. 4 is a fragmentary sectional view of the invention.

By means of the construction set forth above, the base dock 2 may be fastened to a transom W of the boat hull through bolts 41 to fasten an engine 4. One end of the bolt 41 is pivotally coupled with a handle 42 to facilitate screwing. For locking, align and engage the fastening holes 312 with the fastening rods 22, and lock the upper dock 3 and the base dock 2 after they are coupled and reached a desired location. The frame 31 completely cover the bolts 41 and the handles 42, thus the handles 42 cannot be turned (referring to FIGS. 3 and 4), hence the risk of being stolen may be prevented.

Figure 5:
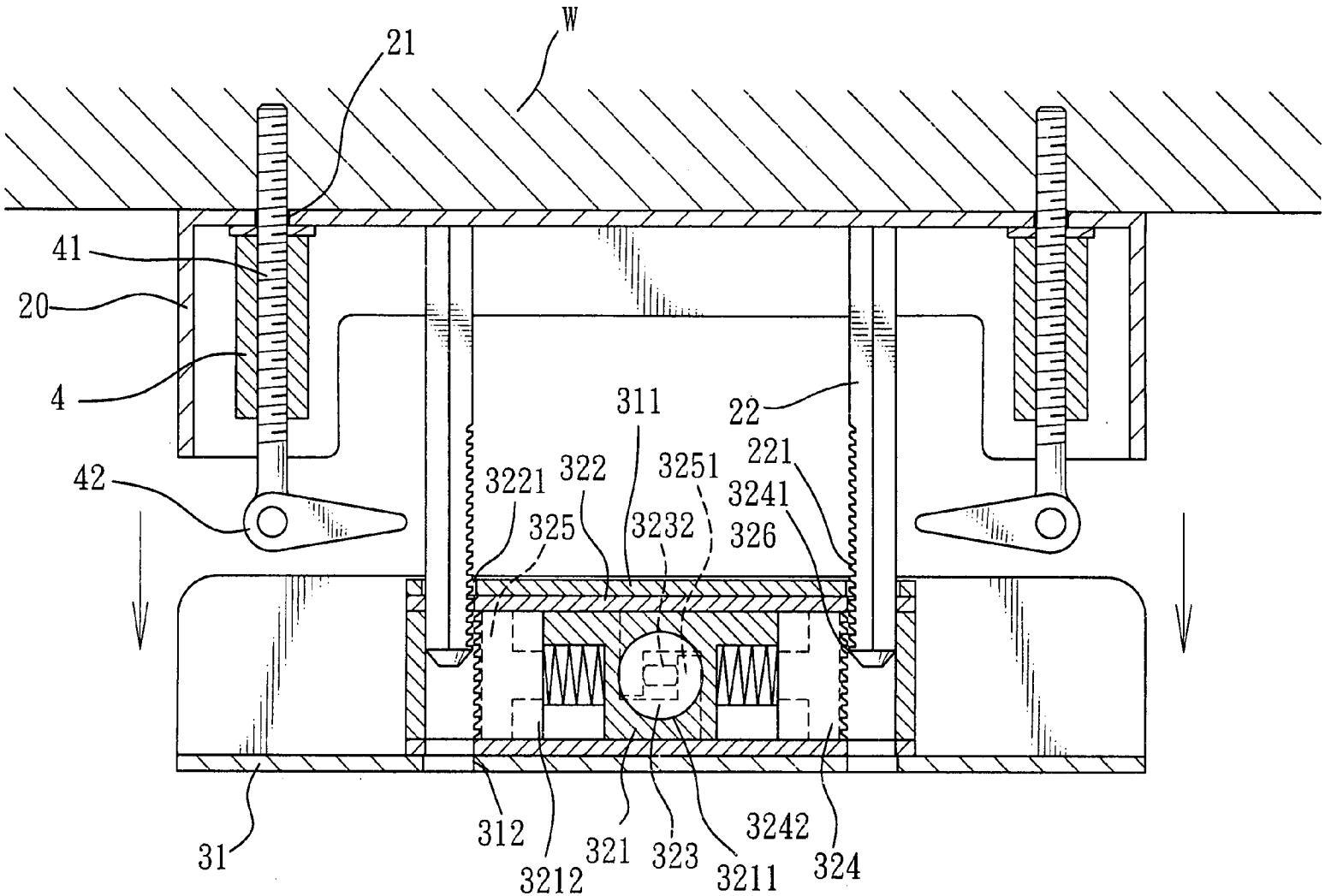
FIG. 5 is a schematic view of the invention in an operating condition.

When there is a desire to remove or use the engine, and the coupling lock A has to be unlocked, insert a key into the keyway 323 to turn the lock bolt 3232 to move the latch members 324, the second gear racks 3241 of the latch members 324 may be disengaged with the first gear racks 221 of the fastening rods 22, and the upper dock 3 may be moved away from the base dock 2 to remove the engine as desired (referring to FIG. 5).

Figure 6:
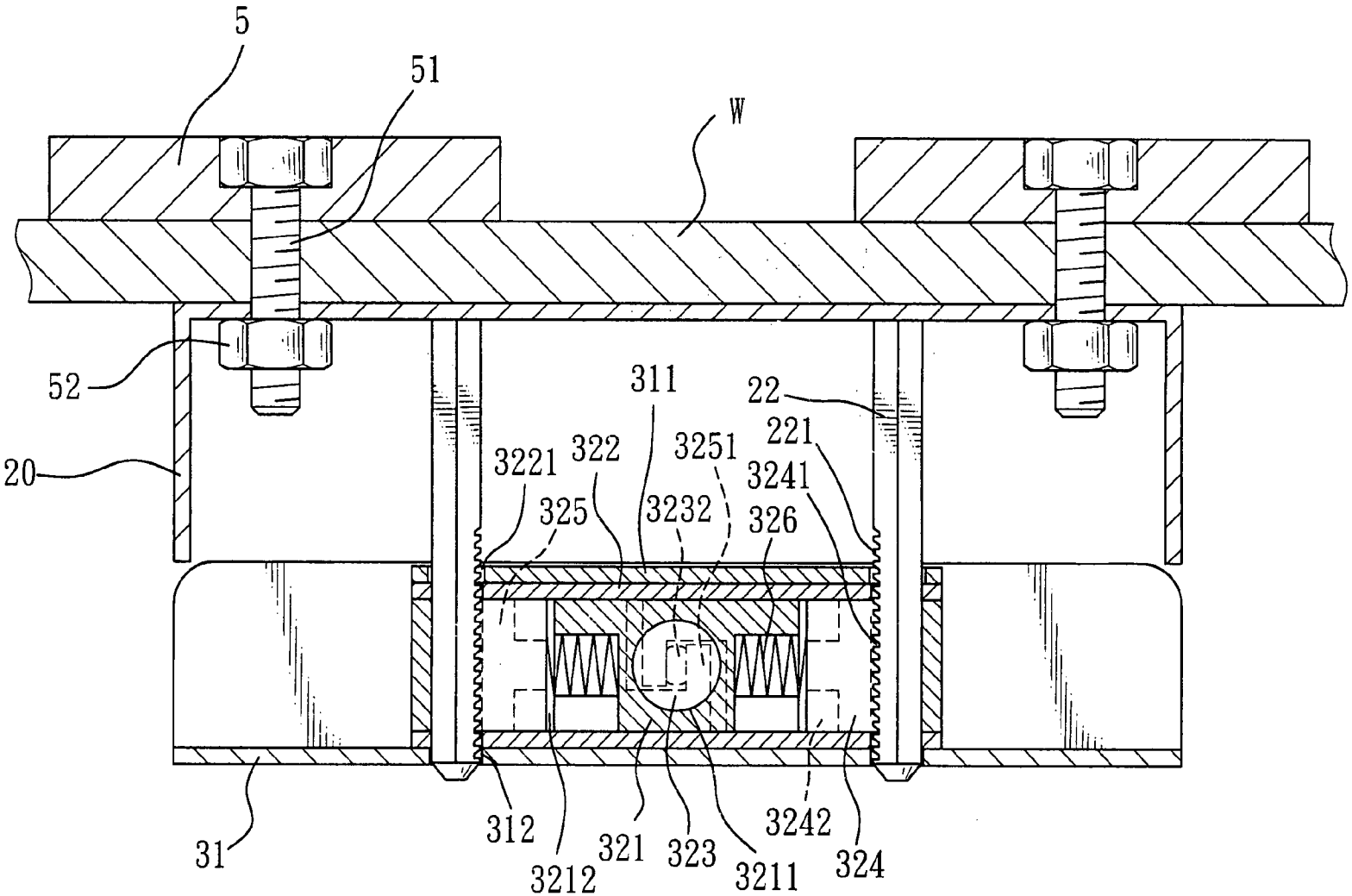
FIG. 6 is a sectional view of the invention used on a large engine.
Figure 7:
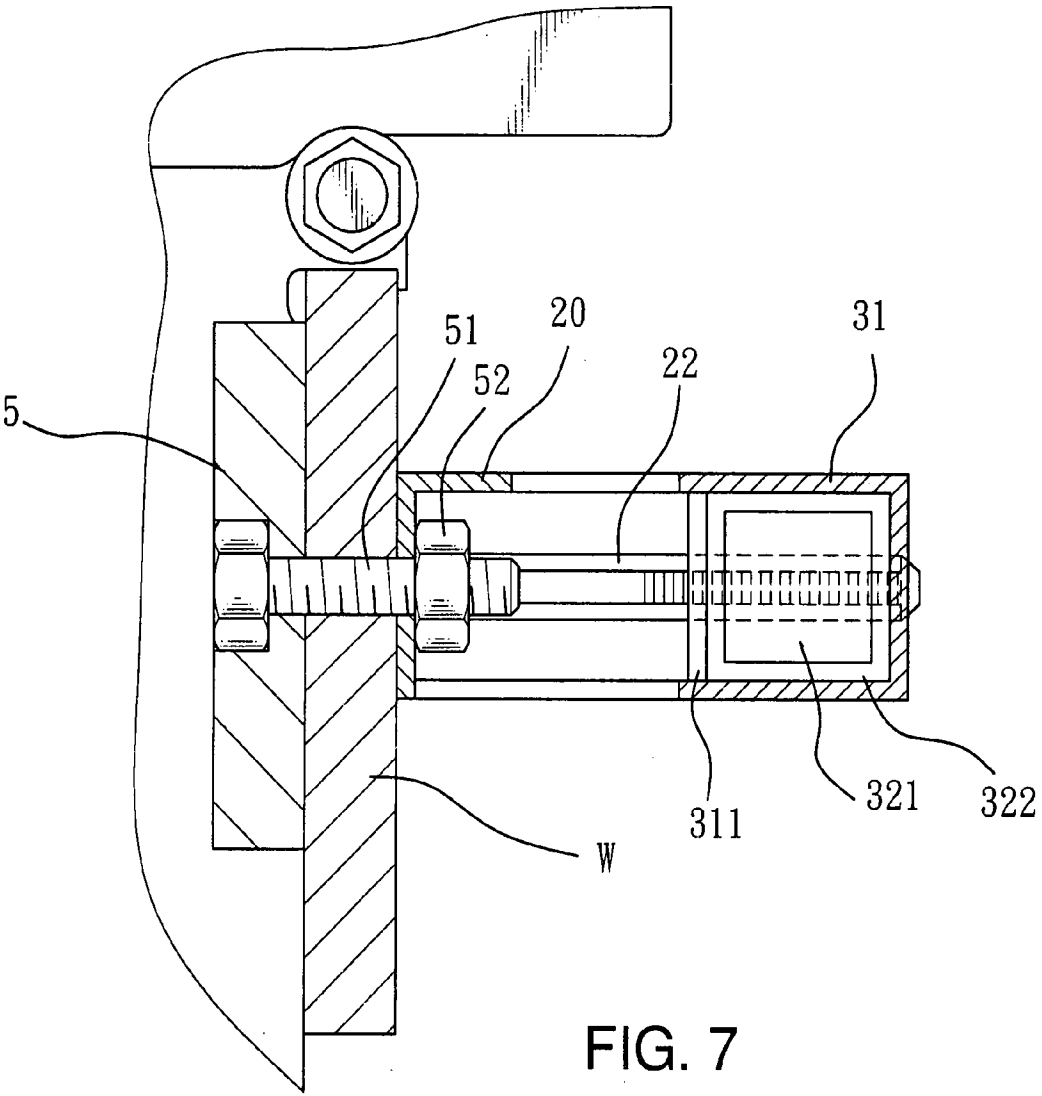
FIG. 7 is a fragmentary sectional view of the invention used on a large engine.

Refer to FIGS. 6 and 7 for the invention adopted for use on a large engine. As the large engine is more difficult to install and remove, it usually is not removed after installation. Hence providing a theft-proof lock is more important. According to the invention, when a large engine 5 is installed, the base dock 2 also is fastened to the transom W at the same time. Then the large engine 5 is fastened through bolts 51 and nuts 52. They are covered by the upper dock 3 to finish the locking operation.

Figure 8:
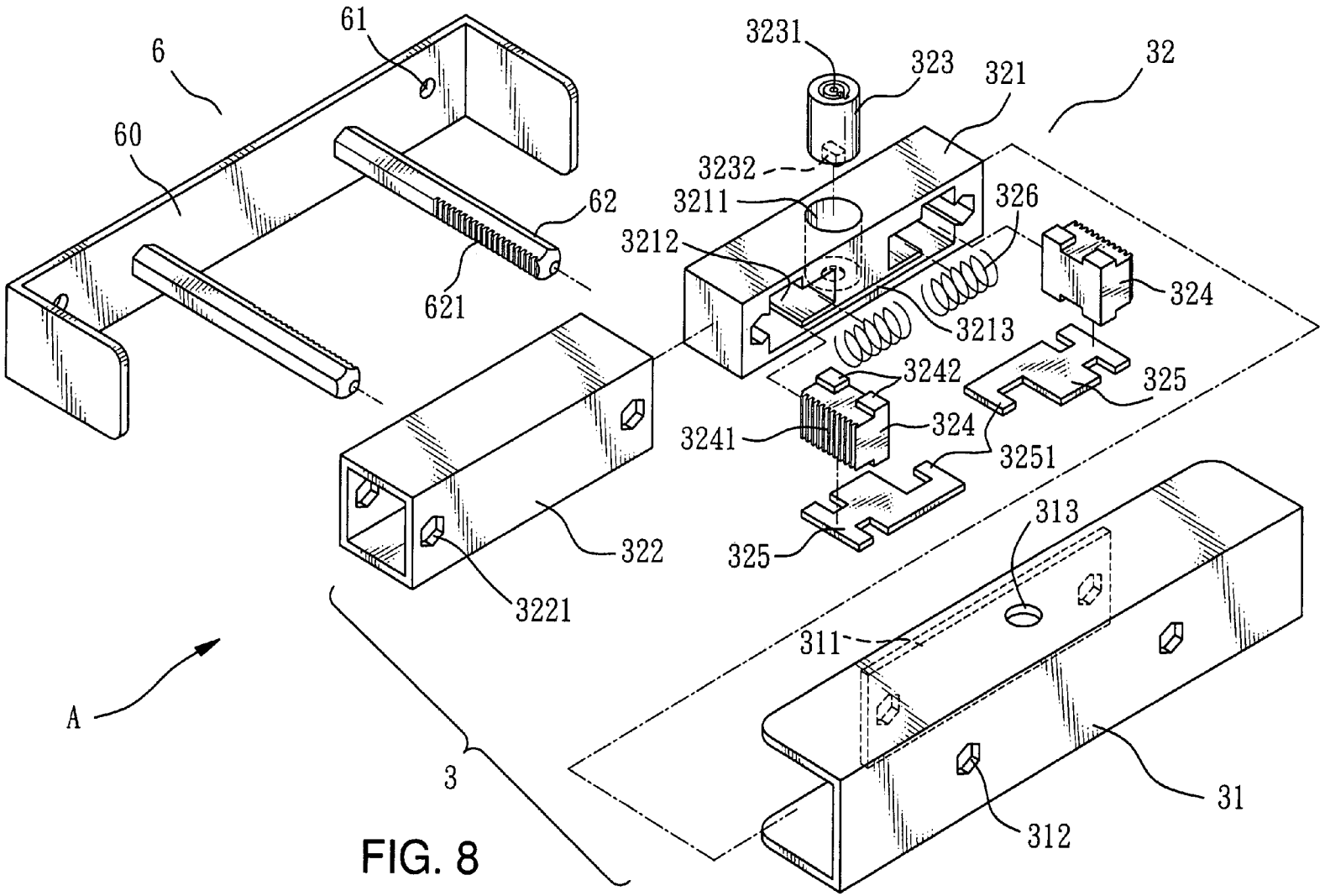
FIG. 8 is an exploded view of another embodiment of the invention.

Refer to FIG. 8 for another embodiment of the invention that is adaptable to a wide variety of engines. A base dock 6 is provided that has a ⊓-shape seat 60 with only two side plates. The bottom has at least one bore 61 and two fastening rods 62 each has a first gear rack 621 on an inner side to run through the upper dock 3 for fastening and locking.

In summary, the invention can rapidly couple and lock an engine on a boat hull to prevent theft. It offers significant improvements over the conventional techniques.

I claim:

1. A coupling lock for an engine and a boat hull comprising a base dock and a upper dock, wherein:

the base dock is fastened to a transom of the boat hull and has two fastening rods extended from the bottom thereof, each of the fastening rods having a first gear rack on an inner side; and the upper dock includes a frame and a lock body housed in the frame to allow the fastening rods to run through and couple therewith, wherein the lock body held in the upper dock includes a lock plug, a lock case, a lock core, two latch members, two sliding plates and two springs; wherein:

the lock plug has a housing chamber in a center thereof to hold the lock core, two latch troughs on two ends of a front side corresponding to each other, a sliding trough on a lower side communicating with the two latch troughs and the housing chamber located thereabove;

the lock case is a hollow member located between the frame and a retaining plate to hold the lock plug, and has apertures on two sides to allow the fastening rods to run through;

the lock core is housed in the housing chamber of the lock plug and has a keyway on one end and a lock bolt on another end which is turnable about a fixed point when the keyway rotates to perform locking and unlocking operation;

the two latch members are located in the latch troughs and have respectively a second gear rack on one side mating the fastening rod and two stubs extended respectively from the upper side and the lower side;

the two sliding plates are located in the sliding trough in an inverse manner, and have one end coupled with the lower side of the latch member and another end forming a hook to latch one side of the lock bolt such that the turning of the lock bolt controls the movement of the latch members to engage or disengage the second gear rack with the first gear rack of the fastening rods; and the two springs are located in the latch trough and have one end pressing one side of the latch members.

2. The coupling lock of claim 1, wherein the frame is a ⊓-shape plate having an opening which is coupled with a retaining plate, the retaining plate and the frame having two corresponding fastening holes to allow the fastening rods to run through.

3. The coupling lock of claim 1, wherein the base dock is a ⊓-shape plate.

* * * * *